US011352842B2

(12) United States Patent
Van Duivendijk et al.

(10) Patent No.: US 11,352,842 B2
(45) Date of Patent: Jun. 7, 2022

(54) RUNNING A SUBSEA RISER STRING

(71) Applicant: ITREC B.V., Schiedam (NL)

(72) Inventors: Pieter Dirk Melis Van Duivendijk, Schiedam (NL); Joop Roodenburg, Schiedam (NL)

(73) Assignee: ITREC B.V., Schiedam (NL)

( * ) Notice: Subject to any disclaimer, the term of this patent is extended or adjusted under 35 U.S.C. 154(b) by 0 days.

(21) Appl. No.: 16/639,210

(22) PCT Filed: Aug. 2, 2018

(86) PCT No.: PCT/NL2018/050532
§ 371 (c)(1),
(2) Date: Feb. 14, 2020

(87) PCT Pub. No.: WO2019/035710
PCT Pub. Date: Feb. 21, 2019

(65) Prior Publication Data

US 2020/0256135 A1 Aug. 13, 2020

(30) Foreign Application Priority Data

Aug. 18, 2017 (NL) ..... 2019427

(51) Int. Cl.
*E21B 19/00* (2006.01)
*E21B 19/02* (2006.01)

(52) U.S. Cl.
CPC ..... *E21B 19/004* (2013.01); *E21B 19/02* (2013.01)

(58) Field of Classification Search
CPC ..... E21B 19/004; E21B 19/02
See application file for complete search history.

(56) References Cited

U.S. PATENT DOCUMENTS 4,668,126 A 5/1987 Burton
8,875,793 B2 * 11/2014 Christensen ..... E21B 19/006 166/345

(Continued)

FOREIGN PATENT DOCUMENTS

EP 2 896 781 A1 10/2014
GB 2 223 074 A 3/1990

(Continued)

OTHER PUBLICATIONS

International Search Report, issued in PCT/NL2018/050532, dated Oct. 23, 2018.

(Continued)

*Primary Examiner* — Matthew R Buck
(74) *Attorney, Agent, or Firm* — Birch, Stewart, Kolasch & Birch, LLP

(57) ABSTRACT

A vessel is adapted to perform subsea wellbore related operations, involving a riser string that extends between a subsea wellbore and a vessel and that is assembled from releasably interconnected riser sections that each comprise a main riser pipe and at least one auxiliary pipe. The vessel includes an auxiliary pipe filling device adapted to fill the at least one auxiliary pipe of a riser section during a lowering step of said riser running operation, the auxiliary pipe filling device including a liquid source, e.g. for water, at least one nozzle adapted to dispense water into said auxiliary pipe, a liquid flow line, connecting the liquid source with the nozzle, and a nozzle mount that is adapted to mount the nozzle in a filling position in which the nozzle is positioned to dispense liquid into the at least one auxiliary pipe of the riser section during said lowering step.

19 Claims, 5 Drawing Sheets

(56) References Cited

U.S. PATENT DOCUMENTS

Figure 1:
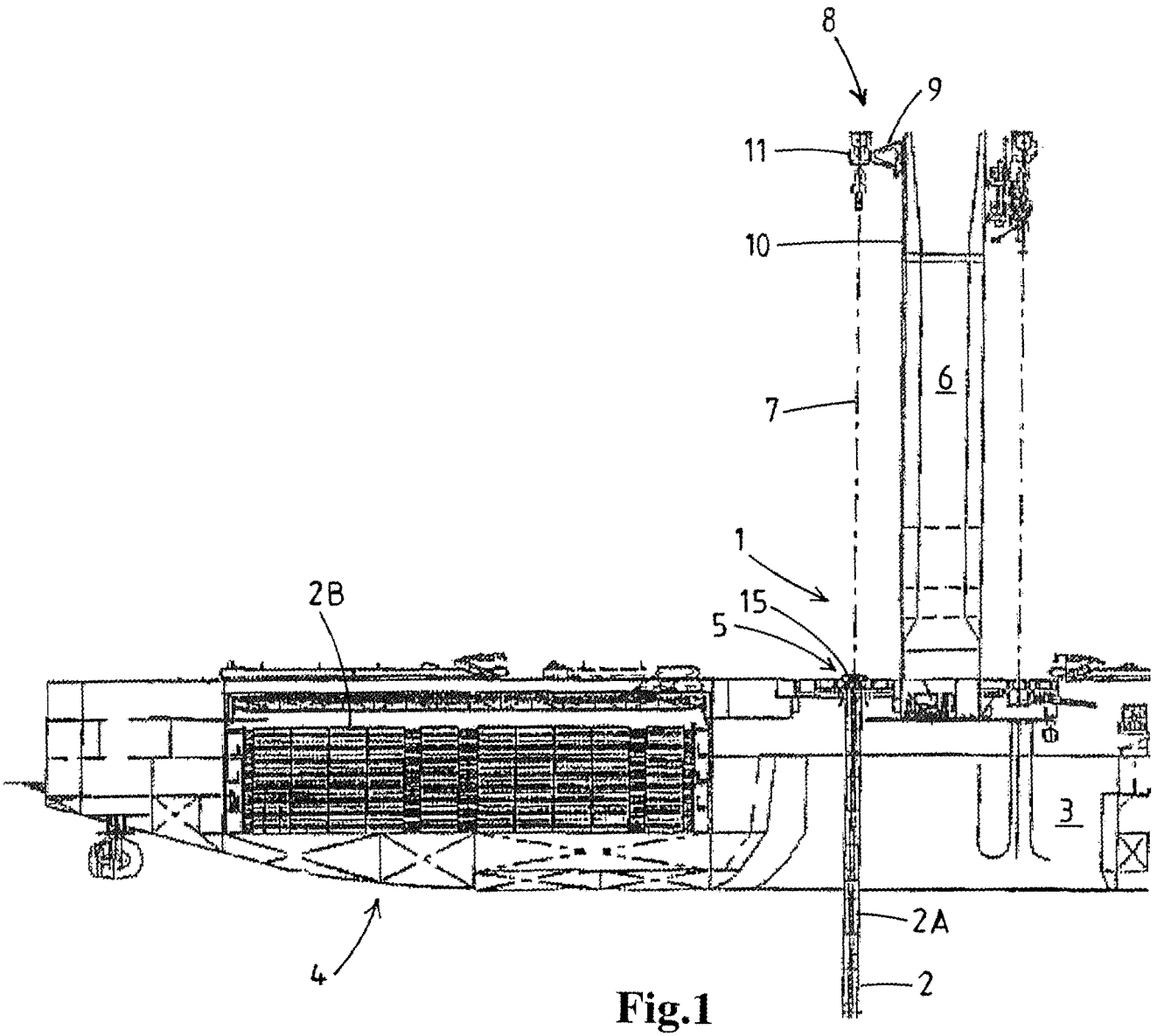

| | | | | |
|---|---|---|---|---|
| 9,702,205 | B2 * | 7/2017 | Jansen | E21B 17/01 |
| 9,719,310 | B2 * | 8/2017 | MacGregor | E21B 17/01 |
| 10,053,920 | B2 * | 8/2018 | Hatton | E21B 17/085 |
| 2014/0083711 | A1 * | 3/2014 | Springett | E21B 19/004 166/345 |

FOREIGN PATENT DOCUMENTS

| | | | |
|---|---|---|---|
| GB | 2545283 | A | 6/2017 |
| WO | WO 2014/168471 | A1 | 10/2014 |
| WO | WO 2015/038329 | A1 | 3/2015 |
| WO | WO 2016/055616 | A2 | 4/2016 |
| WO | WO 2016/094790 | A1 | 6/2016 |
| WO | WO 2016/105187 | A1 | 6/2016 |

OTHER PUBLICATIONS

Written Opinion of the International Searching Authority, issued in PCT/NL2018/050532, dated Oct. 23, 2018.

* cited by examiner

RUNNING A SUBSEA RISER STRING

The present invention relates to the field of subsea wellbore related operations, e.g. drilling and/or wellbore intervention operations, wherein a riser string composed of marine riser sections extends between a vessel adapted to perform subsea wellbore related operations and a subsea wellbore, e.g. drilling and/or wellbore intervention operations.

Commonly a riser section comprises a main riser pipe and additionally one or more auxiliary pipes, also called satellite, service, or peripheral pipes or lines, on the outside of and usually parallel along the main riser pipe. The auxiliary pipes are e.g. used as liquid lines, e.g. to a BOP or other subsea equipment, as choke line, kill line, hydraulic line, booster line, injection line, (e.g. for glycol), etc. The main riser pipe and/or one or more auxiliary pipes can be made of metal, e.g. steel, and/or of synthetic composite material.

In a common design the main riser pipe is provided at each end thereof with a radially extending flange, the main riser pipe and the flanges being made of steel. One or both of the flanges may have bolt holes allowing to join riser sections by means of bolts. However, other connector arrangements to interconnect riser sections, e.g. the known Clip Connector, are also envisaged.

An auxiliary pipe may have an individual connector fitting at its end or ends, e.g. a bayonet fitting, or be designed to fit sealingly into the auxiliary pipe of an adjoining riser section.

Riser sections come in different lengths. Commonly riser sections have lengths between 50 ft. (15.24 meters) and 90 ft. (27.43 meters). A very common length for riser sections is 75 ft. (22.86 meters). In WO2014/168471 it is however proposed to use riser sections having a length of up to 180 ft. (54.86 meters), e.g. 150 ft. (45.72 meters).

Many vessels for subsea wellbore related operations are provided with a riser storage within the hull and/or on deck. In the riser storage, commonly riser sections are stacked in their horizontal orientation. A gantry crane may be provided to raise and lower the riser sections out of and into the storage hold. The riser sections may then be placed onto a riser catwalk machine. The gantry crane may also pick up a riser section from the catwalk machine.

The top or leading end of the riser section is in practice connected to a riser string lifting tool, also known as a riser running tool or a riser handling tool. This riser string lifting tool connects the riser section to a riser string handling capacity hoisting device of the vessel. By raising the lifting tool, the riser section is brought into a vertical orientation, or upended, in line with a firing line along which the riser string is suspended into the sea. The already launched portion of the riser string is then temporarily held by a riser spider device of the vessel. The new riser section is consecutively held in alignment above the launched riser string and the connector fitting arrangements are interconnected to join the new riser section to the riser string. Then the riser string is released by the riser string hanger and lowered over the length of the newly attached section. This operation is known as a riser running operation.

To prevent the auxiliary pipes of the riser section from being overloaded due to deep water pressures, these pipes are typically filled with water during the riser running operation. This filling of the auxiliary pipes nowadays takes place after the new riser section has been attached to the riser string, and the combined riser string and new riser section have been lowered so that the top end of the new riser section is suspended from the riser spider device. A new riser section is coupled to the riser string once this filling of the auxiliary pipes has been finished.

It is an aim of the present invention to make the riser string running process less time-consuming and/or more efficient.

The present invention provides a vessel according to claim 1.

By providing an auxiliary pipe filling device that is configured such that it allows to fill the auxiliary pipe or pipes while the riser with the newly added section is lowered during the riser string running operation, the total required operational time is reduced, making the process of running a riser string more efficient.

In embodiments, the subsea wellbore related operation may be drilling or wellbore intervention or some other operation.

In embodiments, the one or more auxiliary pipes to be filled with liquid according to the invention are arranged on the outside of, and along, the main riser pipe.

In embodiments, the auxiliary pipes to be filled with liquid according to the invention may be later used as a liquid transfer line in a subsea wellbore related process, e.g. to transfer said liquid to and/or from a BOP, other subsea equipment, or into the wellbore.

The water or other liquid that is filled into the one or more auxiliary pipes in the manner according to the invention, e.g. just water or glycol or a mixture of water and glycol, may, in embodiments, not only be used to prevent a collapse of the auxiliary pipes during the riser running, but may later also be used to operate subsea equipment, such as a blowout preventer (BOP), mounted at the lower end of the riser string. The water may for example be used to activate one or more of the rams of the BOP. To guarantee functionality of the liquid, the auxiliary lines are preferably filled with a pure liquid, e.g. fresh water, from an on-board water storage facility, but they may also be filled with seawater, e.g. filtered seawater.

An auxiliary pipe of the riser commonly extends alongside, e.g. parallel to, the main riser pipe, e.g. fixed thereon at intervals, and serve to transfer liquid to and/or from a subsea device, e.g. for controlling a BOP or another subsea device. For example two auxiliary pipes are provided that function as choke line and kill line respectively. The auxiliary pipe may be filled with water as liquid, to transfer instructions during subsea operations by way of pressure changes to subsea devices.

In embodiments, the floating hull of the vessel is a mono-hull type hull.

In embodiments, the riser storage of the vessel is adapted to store therein multiple risers sections.

In embodiments, the hoisting device comprises at least one winch and at least one winch driven cable, wherein a riser string lifting tool is suspended from the at least one cable.

In embodiments, the riser spider device is mounted on a working deck which extends, e.g. in an operative position thereof, above an area of water/the sea, e.g. over the water surface in a moonpool.

In embodiment, the liquid flow line that feeds the liquid to the top end of the one or more auxiliary pipes has a length larger than the length of a riser section.

The auxiliary pipe filling device comprises a source, e.g. for water or another liquid, e.g. a reservoir and/or a water pump. Preferably, this liquid source stores fresh water. For example fresh water is filled into the choke line and/or the kill line, e.g. to ensure that no contaminants are present in these crucial auxiliary lines, e.g. to ensure a reliable operation of the BOP. A main water source may be arranged on a deck of the vessel, or below deck.

In embodiments, there may be a secondary source, e.g. a secondary water source, besides the main source, in liquid communication with the main source, which secondary source is arranged in the tower or is connected to the tower, e.g. near a top of the tower. The secondary source may for example hold the amount of water or other liquid needed to fill the auxiliary pipe or auxiliary pipes of a single riser section, the water flowing in the direction of the gravity when the auxiliary pipes are filled. There may be a pump that pumps water from the main source to the secondary source while a consecutive riser section is coupled to the riser string. So the secondary source functions as an intermediate storage of the liquid at an elevated position on the tower.

In embodiments, the secondary source may be arranged on a trolley that may be provided on the tower, e.g. guided by one or more vertical trolley rails on the tower.

In other embodiments, water may directly be pumped from a main water source, preferably arranged on or below the deck of the vessel, via the liquid flow line or lines and the nozzle or nozzles, into the one or more auxiliary pipes.

In yet other embodiments, water is pumped from the sea; wherein the sea is the water source. One or more treatments may be performed to the sea water before it is entered into the auxiliary pipes, e.g. the seawater is filtered.

The auxiliary pipe filling device further comprises at least one nozzle adapted to dispense liquid, e.g. water, into said auxiliary pipe. Preferably, the number of nozzles matches the number of auxiliary pipes so that all pipes can be filled simultaneously.

The auxiliary pipe filling device further comprises a liquid flow line, e.g. including a hose. The liquid flow line connects the water or other liquid source, e.g. the main and/or secondary source, with the nozzle. The nozzle may be an end portion of the liquid flow line.

In an embodiment the liquid flow line is of such a length that it can follow the riser section from an upended position where it is arranged vertically above the riser string, to the lowered position where the new added riser section is suspended from the riser spider device, allowing a consecutive riser section to be coupled to it.

In an embodiment, a nozzle mount is configured to be releasable fixed to a top end of the riser section, e.g. to the auxiliary pipe.

For example, the nozzle mount may be integrated in the nozzle, wherein the nozzle mount comprises screw wire or other connector that can be secured, e.g. screwed on screw thread, on a connector member that may be provided on the auxiliary pipe.

Alternatively, the nozzle mount may comprise a sleeve that can be coupled with the top end of the auxiliary pipe, e.g. by clicking the nozzle mount onto a flange of the auxiliary pipe. The nozzle mount is advantageously suspended from a hose support that is arranged on the riser string lifting tool of the vertical handling system.

When a nozzle mount is fixed onto a top end of the riser section, it is preferred when the connection between the nozzle mount and the riser section allow for the escape of air that is contained inside the auxiliary pipes before liquid is dispensed therein. This may for example be achieved by providing a connection between the nozzle and the riser section that allows for the escape of air, or by providing an air-tight connection between the nozzle and the riser section where the nozzle is provided with air vents at a radial outer portion thereof.

The nozzle mount may alternatively be arranged or configured to be arranged on a riser string lifting tool. During the filling of the one or more auxiliary pipes the riser string lifting tool then is lowered along with the riser section. This design for example allows to keep the distance between the open top end of the riser section and the nozzle mount substantially constant.

In an embodiment, the nozzle may be a hose extending from the nozzle mount, into the open end of the auxiliary pipe.

Embodiments are conceivable wherein multiple auxiliary lines are present on a single riser section, and wherein the nozzle mount is mounted to the riser string lifting tool. A central liquid flow line, e.g. a hose, may then be arranged between the source and the nozzle mount, at which nozzle mount the hose splits into multiple secondary conduits, e.g. hoses, wherein preferably the number of auxiliary pipes of the riser section equals the number of secondary hoses, such that one secondary hose can be directed towards each auxiliary line. The nozzle is then provided as at the end portion of each secondary conduit, e.g. hose.

In an embodiment, the nozzle mount is provided with a positioning member which is to be mated with a portion of a top end of the riser section, e.g. inserted in a slot or opening in a flange of a riser section, to position and/or secure the auxiliary pipe filling device on the riser section. For example, a positioning pin with a spring resistance will allow for relatively easy attachment and detachment of the nozzle mount onto or from the flange of the riser section. Securing the nozzle mount with respect to the riser section is important with regards to safety, especially when relatively long riser section are used, and when the nozzle mount is thus attached relatively high above the deck of the vessel. Embodiments are conceivable where more than one positioning pin is used, e.g. two positioning pins that are arranged at diametrically opposite sides of the riser section.

In an embodiment, the at least one nozzle is movably supported by the nozzle mount, such that the at least one nozzle can be moved between the filling position and a non-operative or passive position, in which filling position the at least one nozzle is positioned adjacent to, e.g. in proximity of, or partially inserted into an open top end of the at least one auxiliary pipe of a riser section, and in which non-operative or passive position the at least one nozzle is positioned away from the open end of the at least one auxiliary pipe. For example, the nozzle may be able to move along a semi-circular, curved, or straight path from a position close to the open end of the at least one auxiliary pipe, to a position away, e.g. above, the auxiliary pipe.

The nozzle may be configured to be partially inserted into the open top end of the auxiliary pipe, when the nozzle is in the filling position, e.g. when the nozzle is smaller in size than the auxiliary pipe. The nozzle may also be placed onto or adjacent said open end. For example, the nozzle may be arranged above said open end in a filling position, preferably just above the open end to minimize spilling of water.

In embodiments, the nozzle may be coupled with the open end of the at least one auxiliary pipe. For example, the nozzle may be provided with a stab connector or with a connector sleeve that can be coupled with an inner or outer screw thread section of the auxiliary pipe. For example, the connector sleeve may be the nozzle mount, where the nozzle mount is then integrated with the nozzle.

In an embodiment, the auxiliary pipe filling device is provided with a valve, preferably a hydraulically actuated valve, which valve can be remotely operated such that the valve can be opened when the riser section is engaged by the riser string lifting tool and in an upended position, to enable the auxiliary pipe to be filled while the riser section is being lowered along the firing line.

Embodiments are conceivable where the auxiliary pipe filling device is mounted on the top end of the auxiliary pipe or pipes when the riser section is in a horizontal position, on the deck of the vessel or near the deck of the vessel. The auxiliary pipe filling device may then travel towards the top of the tower as the riser section is upended and brought in line with the firing line. The valve may then open once the lower end of the vessel is mounted to the riser string, allowing water from the nozzle to enter the auxiliary pipe.

In other embodiments, the nozzle of the auxiliary pipe filling device may only be mounted onto the auxiliary pipes once the riser section is brought into the upended position. In this embodiment, a valve may be beneficial as well, to delay the filling of the auxiliary pipes until the riser section is securely mounted to the riser string.

In yet other embodiments, the nozzle is mounted onto the auxiliary pipes only when the bottom end of the riser section is coupled with the top end of the riser string. In such an embodiment, the valve may be opened only when the mounting of the nozzle onto the auxiliary pipe is completed.

The valve may be arranged in the liquid flow line, near the water or other liquid source. The valve may also or alternatively be arranged in the water or other liquid source, near the location where the liquid flow line is connected thereto. Yet further or yet alternatively, the valve may be arranged near the nozzle of the auxiliary pipe filling device.

According to embodiments, the liquid flow line is flexible, and a riser string lifting tool is provided with a liquid flow line support that is configured to support at least a section of the liquid flow line, preferably a support that allows for removal of the liquid flow line from the support when the filling device is not in use.

According to embodiments, the liquid flow line extends from the working deck to the top end of the riser section supported by the riser string lifting tool, when the riser string lifting tool is in a lifted position and supports a new riser section in the firing line above the riser spider device. The riser spider device may for example be supported by a working deck. It may be preferred that excess length of the liquid flow line can be buffered in a buffer zone. When said buffer zone is arranged on a deck of the vessel, the nozzle can for example be mounted to the at least one auxiliary pipe before the riser section is upended. The liquid flow line should then follow the top end of the riser section as said top end is brought towards a vertical orientation, the buffer emptying while the riser section is brought from a horizontal towards a vertical orientation. When the nozzle fills the auxiliary pipes after the riser section has been mounted to the riser string, and as the riser section moves downwards towards sea level, the liquid flow line again moves along with the riser section, and excess length of the liquid flow line can be buffered in the buffer zone. Advantageously, when the buffer zone is arranged on deck, it can be removed to a remote location when no running operation is performed, creating more space on the area of the deck surrounding the tower.

In an alternative embodiment, the liquid flow line extends from a top end of the tower to the top end of the riser section supported by the riser string lifting tool, when the riser string lifting tool is in a lowered position in which it is located near the riser spider. Hence, a buffer zone for excess length of liquid flow line may be arranged in the tower, e.g. halfway along the length of the tower, or near the top of the tower. This advantageously leaves more space on the deck around the tower. However, when the buffer zone is arranged in the tower, it may be more cumbersome to remove the liquid flow line from the tower when said liquid flow line is not used. For example, a crane may be required for this removal, or it might be necessary to rotate or translate the liquid flow line and/or the buffer zone away from the firing line.

Although advantageous, the presence of a buffer zone is not required.

The invention also relates to a riser string lifting tool according to claim 12.

Although certain embodiments of the auxiliary pipe filling device have been described in the above in relation to a vessel comprising an auxiliary pipe filling device, the same embodiments may be conceived for a riser string lifting tool according to the invention.

The present invention further relates to a method for running of a subsea riser string by interconnection of riser sections, preferably using a vessel according to one or more of the preceding claims, to compose a riser string that extends between a vessel and a subsea wellbore, e.g. in a drilling and/or wellbore intervention operation, wherein the riser string is assembled from releasably interconnected riser sections that comprise a main riser pipe and at least one auxiliary pipe that may be used as liquid line, e.g. to a BOP or other subsea equipment, and that may be arranged on the outside of, and along, the main riser pipe, the method comprising the steps:

engaging a top end of the riser section with a riser string lifting tool, positioning a nozzle in a filling position at a top end of the at least one auxiliary pipe of the riser section;

securing a lower or rear end of the riser section with a top end of a launched riser string; and filling the at least one auxiliary pipe using the nozzle while lowering the riser section and the riser string connected thereto.

It is noted that the steps of the above method may be performed in a different order than the order that is listed above. For example, it is conceivable that the nozzle is only positioned at the top of the auxiliary pipe after the rear end of the riser section has been connected to the top end of the riser string.

Filling of the auxiliary pipe needs not be completed while lowering the riser section and the riser string connected thereto. Any method wherein the filling of the auxiliary pipe is started while lowering the riser section and the riser string, provides a more efficient method than currently known methods.

In many known vessels, risers are stored horizontally, e.g. below or on deck. For such vessels, it is conceivable when the method further comprises the steps of positioning a riser section, that is to be connected to the riser string, in a horizontal position, e.g. near the tower, and of upending the riser section from the horizontal initial orientation by lifting the top end of the riser section, bringing the riser section into a vertical or upended orientation and in line with the firing line along which the riser string is suspended into sea. Upending of the riser section may in practical embodiments be done with the riser string lifting tool, but it may also be done with another device, e.g. a loader device that is separate from the tower and any trolley on said tower when present.

The method may further comprise installing a blowout preventer stack (BOP), wherein the riser string comprises a main riser pipe and two or more auxiliary pipes on the outside of and along the main riser pipe, and wherein the two or more auxiliary pipes are to be used as choke/kill lines extending from the vessel to the BOP located at the sea floor, the method then further comprising the steps of:

moving a BOP of the vessel to a position in the firing line, and moving a first riser section including choke/kill lines in the firing line, the riser section being positioned above the BOP connecting the first length of main riser pipe and two or more choke/kill lines to said BOP.

Figure 2:
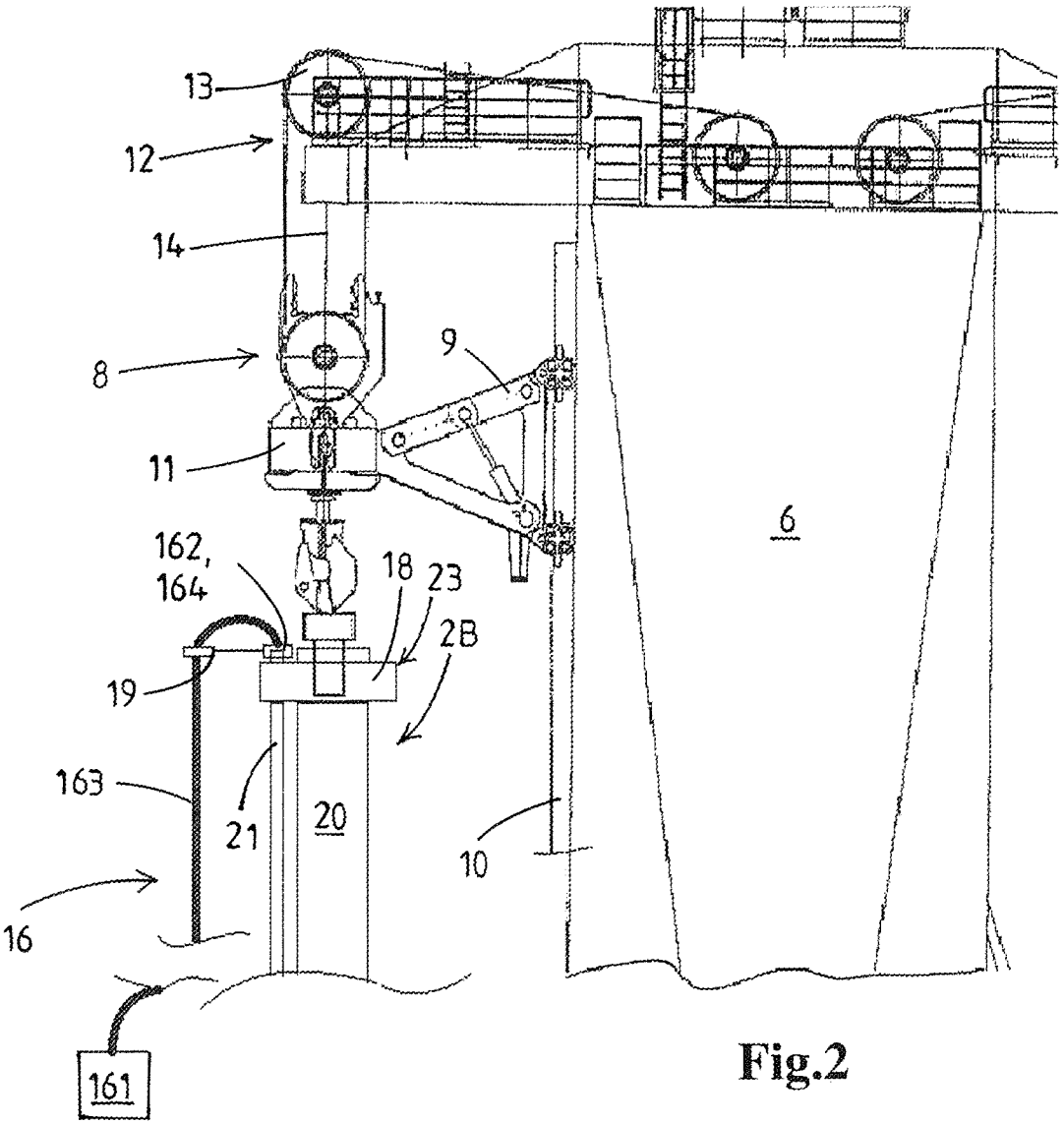
Figure 3:
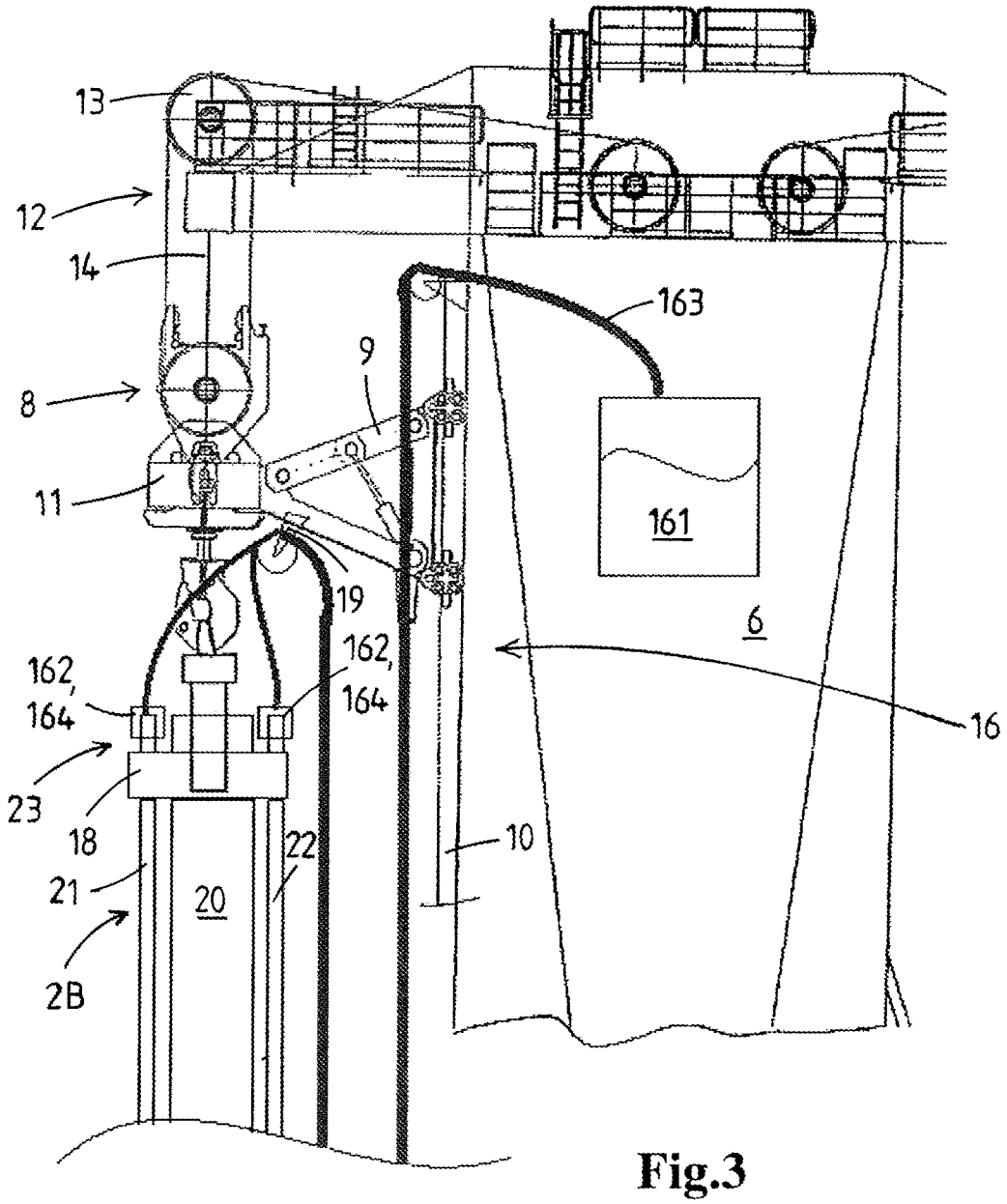
Figure 4:
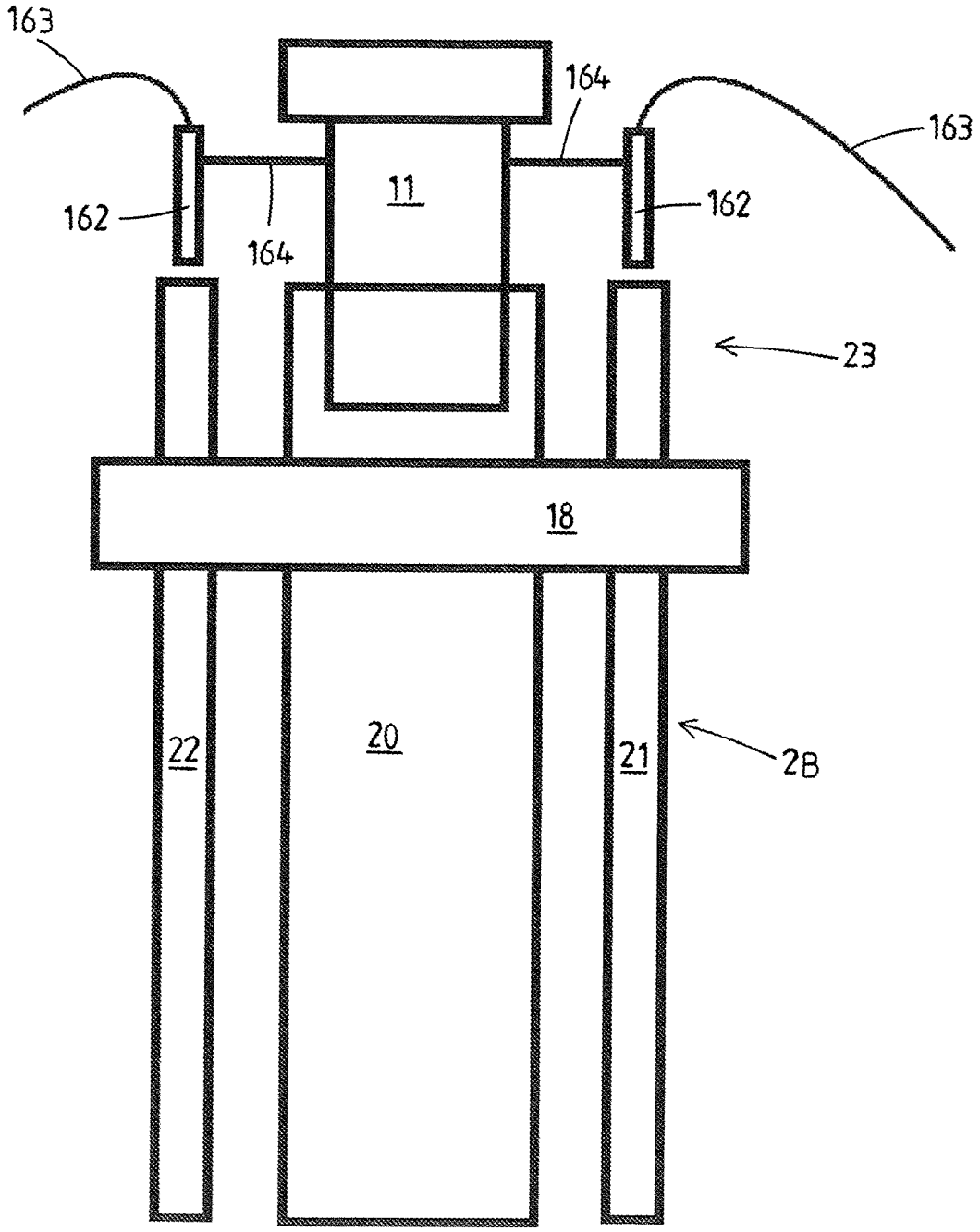
Figure 5:
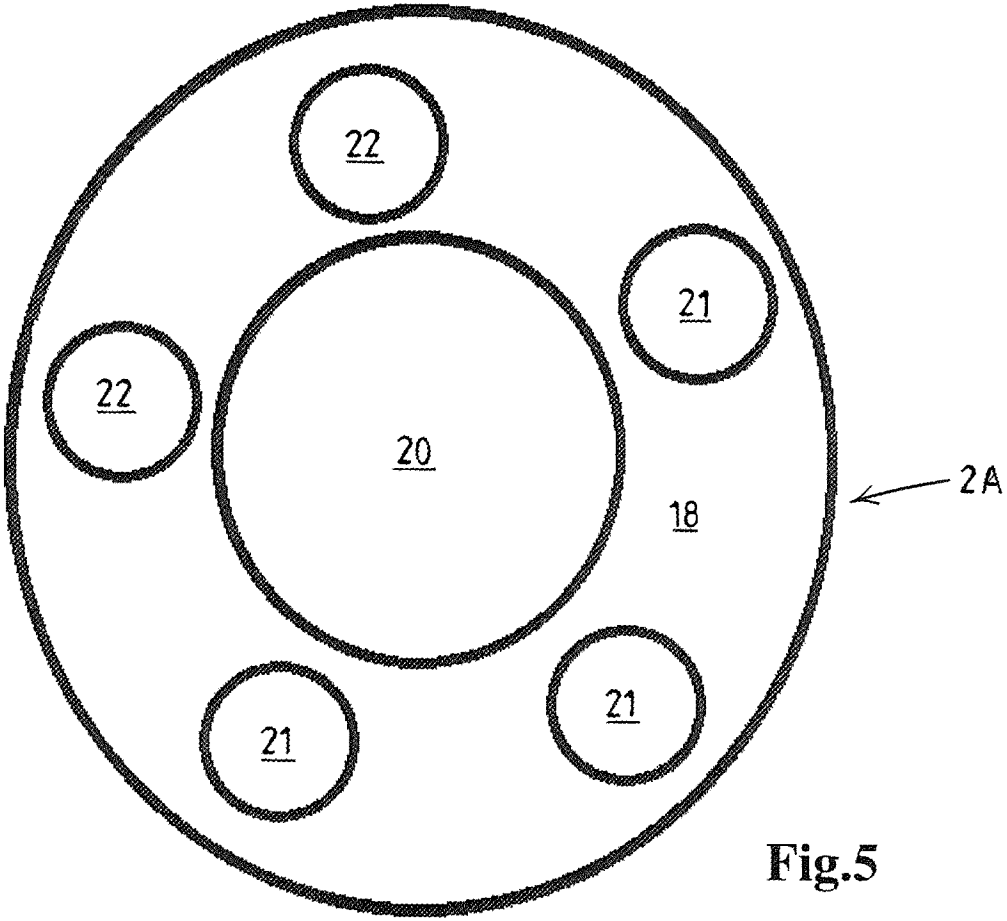

The invention will now be described in more detail with reference to the drawings. In the drawings:

FIG. 1 schematically shows a vessel according to an embodiment of the invention, FIG. 2 schematically shows a detailed view of a top end of a tower, comprising a riser string lifting tool, a riser section, and a first embodiment of the auxiliary pipe filling device, FIG. 3 schematically shows a detailed view of a top end of a tower, comprising a riser string lifting tool, a riser section, and a second embodiment of the auxiliary pipe filling device, FIG. 4 schematically shows riser string lifting tool, a riser section and a third embodiment of the auxiliary pipe filling device, FIG. 5 schematically shows a top view of a riser section comprising auxiliary pipes.

FIG. 1 schematically shows a vessel 1 adapted to perform subsea wellbore related operations, e.g. drilling and/or wellbore intervention, involving a riser string 2 that extends between a subsea wellbore and a vessel. The riser string 2 is assembled from releasably interconnected riser sections 2A that each comprise a main riser pipe and at least one auxiliary pipe on the outside of and along, e.g. parallel to, the main riser pipe. An exemplary embodiment of a riser section 2A will be described more elaborately below with reference to FIG. 5.

In the embodiment of FIG. 1, the vessel comprises a floating hull 3, here of the mono-hull type. The vessel further comprises a riser storage 4 adapted to store therein multiple risers sections 2B, e.g. riser section having a length of between 50 ft. and 180 ft., such as riser sections having a length of 75 ft., 90 ft., or 150 ft.

The vessel further comprises a moonpool 5 in said hull 3 and a tower 6 arranged at said moonpool 5 and fixed to said hull 3, the tower 6 defining a firing line 7 along which the riser string 2 is launched towards the subsea wellbore.

The vessel 1 further comprises a vertical handling system 8, here a riser string vertical handling system, the riser string vertical handling system here comprising a travelling device 9, a riser string lifting tool 11, and a hoisting device (see FIGS. 2 and 3). The travelling device 9 is movable up and down along the tower 6. It may for example be guided by one or more vertical rails 10 mounted on said tower 6, the travelling device 9 e.g. being a wheeled travelling device having wheels engaging said one or more vertical rails 10.

The vessel further comprises a riser spider device 15 that is supported above the water in the moonpool 5 and that is adapted to temporarily suspend therefrom a riser string 2 into the sea at least during the riser running or assembly process. The riser spider device 15 has a riser string passage therein through which the riser string 2 can pass, wherein the riser spider device 15 is preferably mounted on a working deck which extends, e.g. in an operative position thereof, above at least an area of the water in the moonpool 5.

The riser running operation comprises a securing step wherein a new riser section 2A, 2B held by the vertical handling system 8 is secured on top of said suspended riser string 2 and wherein the riser running operation comprises a lowering step wherein the vertical handling system 8 lowers the riser string 2 so that the top end thereof moves down relative to the tower 6 when the riser spider device 15 is disengaged from the riser string 2, As is clearly visible in FIGS. 2 and 3, the riser string lifting tool 11 is mounted on said travelling device 9 and is adapted to connect to a top end 23 of a riser section 2B, the riser string lifting tool 11 being embodied to support the weight of the riser string. The travelling device 9 and the riser string lifting tool 11 are suspended from the tower 6 by the hoisting device 12, the hoisting device 12 being adapted to move the riser string 2, when it is connected thereto, via the riser string lifting tool 11 and in unison with the travelling device 9 up and down relative to the tower 6.

As shown, the hoisting device 12 comprises a winch 13 and a winch driven cable 14, wherein the riser string lifting tool 11 and the travelling device 9 are suspended from said at least one cable 14.

Further visible in FIGS. 2 and 3, are embodiments of an auxiliary pipe filling device 16 that is configured to least partially fill the at least one auxiliary pipe 21, 22 of a riser section 2B during said lowering step of the riser running operation, the auxiliary pipe filling device 16 comprising a water or other liquid source 161, here a water source 161, e.g. a reservoir and/or a water pump, at least one nozzle 162 for dispensing water into said auxiliary pipe 21, 22, a liquid flow line 163, e.g. a drape hose, and a nozzle mount 164. The liquid flow line 163 connects the water source 161 with the nozzle 162 and preferably has a length larger than the length of a riser section 2A, 2B. The nozzle mount 164 mounts the nozzle 162 in a filling position in which the nozzle 162 is positioned to dispense water into the at least one auxiliary pipe 21, 22 of the riser section 2B during the lowering step.

FIGS. 2 and 3 show how the nozzle mount 164 can be fixed to the top end 23 of the riser section 2B. Here, the nozzle mount 164 is directly fixed to the auxiliary pipes 21, 22. This fixed connection is preferably releasable, allowing the auxiliary pipe filling device 16 to be used for a consecutive riser section, when there is a consecutive riser section, and allowing the top end 23 of the auxiliary pipes 21, 22 to be connected to a bottom end of auxiliary pipes of a consecutive riser section, when there is a consecutive riser section.

As FIG. 4 shows, it is not necessary to fix the nozzle mount 164 to the top end 23 of the riser section 2B. The nozzle mount 164 may not be fixed at all, the nozzles 162 simply extending into the auxiliary pipes 21, 22. The nozzle mount 164 may also be mounted onto the riser string lifting tool 11, as shown in the embodiment of FIG. 4. Yet other embodiments are conceivable, e.g. where the nozzle mount is releasably fixed to the travelling device.

For example, in a non-shown embodiment the nozzle mount is provided with a positioning pin which is to be inserted in a slot or opening in a flange of a riser section, to position and/or secure the auxiliary pipe filling device on the riser section.

As for example visible with respect to FIG. 4, the nozzles 162 may be movably supported by the nozzle mount 164. Here the nozzle mount 164 is an arm that is hingedly connected to the riser string lifting tool 11, which arm may be able to hinge with respect to a longitudinal axis of the riser string lifting tool 11, i.e. out of an imaginary plane spanned by the paper. This allows the nozzles 162 to be moved between the filling position and a non-operative or passive position, where a possible filling position is shown in FIG. 4, with each nozzle 162 positioned above an open top end 23 of a respective auxiliary pipe 21, 22 of the riser section 2B. In the passive position, the nozzles 162 are then positioned away from the open end 23 of the auxiliary pipes 21, 22.

In other embodiments, the movement of the nozzle mount between the filling position and the passive position may be achieved by an extending and/or retracting motion, and/or by an upwards and/or downwards sliding movement of the nozzle mounts. For example, the position shown in FIG. 4 may alternatively be the passive position, wherein the nozzle mounts 164 are slid downwards to bring the nozzles 162 into the auxiliary pipes 21, 22 and into the filling position. Hence, the nozzle 162 may be configured to be, at least partially, inserted in an open end 23 of the at least one auxiliary pipe 21, 22.

With reference to FIGS. 2 and 3, it is shown how the nozzle 162 is configured to be coupled with the open end 23 of the at least one auxiliary pipe 21, 22. The nozzles 162 here comprise a connector sleeve that can be coupled with an outer screw thread section of the auxiliary pipe 21, 22. The nozzle mount 164 is here then embodied as a connector sleeve.

In a conceivable, non-shown, embodiment, the auxiliary pipe filling device is provided with a valve or pump, such as a hydraulically actuated valve, which valve or pump can be remotely operated such that the valve or pump can be opened respectively activated when the riser section is engaged by the riser string lifting tool and in an upended position, to enable the auxiliary pipe to be filled while the riser section is being lowered along the firing line.

As shown with reference to FIGS. 2 and 3, the liquid flow line 163 may be flexible, where at least a section of the liquid flow line 163 may be supported by a liquid flow line support 19.

For example, the liquid flow line support 19 may be attached to the travelling device 9, as shown in FIG. 3, or to riser string lifting tool 11. Preferably, the support 19 is adapted to allow removal of the liquid flow line 163 from the support 19 when the filling device 16 is not in use. For example, with respect to the embodiment of FIG. 3, the nozzles 162 and nozzle mounts 164 may be releasable mounted onto the liquid flow line 163, such that they can be removed when the last riser section 2B of the riser string 2 is filled with water and is supported by the riser spider device. One can then pull the liquid flow line 163 through support 19, allowing removal of the liquid flow line 163 from the support 19 while the filling device 16 is not in use.

With respect to FIG. 2, it is shown how the water source 161 is arranged substantially below the top of the tower 6, preferably on or near deck level. When the riser string lifting tool 11 is now in a lifted position, as shown, and supporting the riser section 2B in the firing line above a working deck supporting the riser spider, the liquid flow line 163 extends from the working deck to the top end 23 of the riser section 2B supported by the riser string lifting tool 11.

With respect to FIG. 3, where a second embodiment of the auxiliary pipe filling device 16 is shown, with secondary or main water source 161 arranged near the top of the tower 6, it can be seen that the liquid flow line 163 partially extends downwards along the tower 6 when the riser string lifting tool 11 is in a lifted position. Instead of extending partially downwards along the tower 6, the liquid flow line 163 may, alternatively, be stored in a buffer, e.g. on a spool.

In the embodiment of FIG. 3, it will be clear that the liquid flow line 163, when the riser string lifting tool 163 is in the lowered position near the riser spider, extends from a top end of the tower 6 to the top end 23 of the riser section 2A 2B supported by said riser string lifting tool.

Shown with reference to FIG. 5 is a schematic top view of a riser section 2B, the riser section 2B comprising a main riser pipe 20, multiple auxiliary pipes 21, 22 distributed on the outside of, and along, the main riser pipe 20, and a flange 18. Besides a main riser section 20 and one or more auxiliary pipes 21, 22, riser sections 2B often also comprise buoyance means, arranged near an outer side of the section. The auxiliary pipe 21, 22 may be used as a liquid line, e.g. to a BOP or other subsea equipment, e.g. comprising water, or another fluid.

Shown in FIG. 4 is a riser string lifting tool 11 comprising a nozzle mount 164 and/or a nozzle 162 of an auxiliary pipe filling device 16 adapted to fill at least one auxiliary pipe 21 of a riser section 2A, 2B during a lowering step of a riser running operation, wherein the auxiliary pipe filling device 16 further comprises:

- a water source 161, e.g. a reservoir and/or a water pump;
- a liquid flow line 163, e.g. a hose, the liquid flow line 163 connecting the water source 161 with the nozzle 162,
- wherein the nozzle 162 is adapted to dispense water into said auxiliary pipe, and
- wherein the nozzle mount 164 is adapted to mount the nozzle 162 in a filling position in which the nozzle 162 is positioned to dispense water into the at least one auxiliary pipe 21, 22 of the riser section 2A, 2B during said lowering step.

Although certain embodiments of the auxiliary pipe filling device have been described in the above in relation to a vessel comprising an auxiliary pipe filling device, the same embodiments may be conceived for a riser string lifting tool comprising an auxiliary pipe filling device.

In use, when running a subsea riser string 2 by interconnecting multiple riser sections 2A, 2B as a first step a blowout preventer stack (BOP) (not shown) may be positioned in a firing line 7, e.g. at a moonpool of a vessel. A first riser section 2A including a main riser pipe 20 and choke/kill lines 21, 22 may consecutively be moved into the firing line 7, the riser section 2A being positioned above the BOP. As a third step, the first length of main riser pipe 20 and the two or more kill/choke lines 21, 22 are connected to the BOP. The BOP and riser section 2A are then released into sea, towards a subsea wellbore; the riser section 2A defining a riser string 2.

To elongate the riser string 2, a further riser section 2B may be connected to the riser string 2. Therefore, the riser section 2B, that is to be connected to the riser string 2, may be brought in a horizontal position near a tower 6. Then, a top end 23 of the riser section 2B may be engaged with a riser string lifting tool 11. Afterwards, a nozzle 162 may be positioned at a top end 23 of the auxiliary pipes 21, 22 of the riser section 2B, in a filling position of said nozzle 162. Then, the riser section 2B may be upended from its horizontal position towards its vertical position, into the firing line 7, after which a bottom end of the riser section 2B is connected to a top end of the riser string 2. Consecutively, the at least one auxiliary pipe 21, 22 may be filled using the nozzle 162, while the riser section 2B and the riser string 2 are lowered towards the subsea wellbore.

Hence, the invention further relates to a method for running of a subsea riser string 2 by interconnection of riser sections 2A, 2B, preferably using a vessel and/or a riser string lifting tool according to the invention, to compose a riser string 2 that extends between a vessel 1 and a subsea wellbore, e.g. in a drilling and/or wellbore intervention operation, wherein the riser string 2 is assembled from releasably interconnected riser sections 2A, 2B that comprise a main riser pipe 20 and at least one auxiliary pipe 21, 22, the method comprising the steps:

engaging a top end 23 of the riser section 2A, 2B with a riser string lifting tool 11, positioning a nozzle 162 in a filling position at a top end 23 of the at least one auxiliary pipe 21, 22 of the riser section 2A, 2B;

connecting a rear end of the riser section 2A, 2B with a top end of the riser string 2; and filling the at least one auxiliary pipe 21, 22 using the nozzle 162 while lowering the riser section 2A, 2B and the riser string 2 connected thereto.

The invention claimed is:

1. A vessel adapted to perform subsea wellbore related operations, involving a riser string that extends between a subsea wellbore and the vessel, the riser string being assembled from releasably interconnected riser sections that each comprise a main riser pipe and at least one auxiliary pipe, said vessel comprising a floating hull, a riser storage, and a tower fixed to said hull and defining a firing line, said vessel further comprising:

a vertical handling system comprising:

a riser string lifting tool adapted to connect to a top end of a riser section, and embodied to support the weight of the riser string;

a hoisting device by which said riser string lifting tool is suspended from the tower, the hoisting device being adapted to move the riser string connected thereto via the riser string lifting tool up and down relative to the tower; and a riser spider device adapted to temporarily suspend therefrom the riser string into the sea at least during a riser running operation, the riser spider device having a riser string passage therein through which the riser string passes, wherein the riser running operation comprises a securing step wherein a new riser section held by the vertical handling system is secured on top of said suspended riser string and wherein the riser running operation comprises a lowering step wherein the vertical handling system lowers the riser string so that the top end thereof moves down relative to the tower when the riser spider device is disengaged from the riser string, said vessel further comprising:

an auxiliary pipe filling device adapted to fill the at least one auxiliary pipe of a riser section with a liquid during said lowering step of said riser running operation, the auxiliary pipe filling device comprising:

a water or other liquid source;

at least one nozzle adapted to dispense water or other liquid into said auxiliary pipe;

a liquid flow line, the liquid flow line connecting the water or other liquid source with the nozzle; wherein the liquid flow line is flexible, and the riser string lifting tool is provided with a liquid flow line support that is configured to support at least a section of the liquid flow line, and wherein the liquid flow line is of such a length that the liquid flow line can follow the riser section from an upended position where the riser section is arranged vertically above the riser string, to a lowered position where the new added riser section is suspended from the riser spider device, allowing a consecutive riser section to be coupled to the riser section; and a nozzle mount, adapted to mount the nozzle in a filling position in which the nozzle is positioned to dispense the water or other liquid into the at least one auxiliary pipe of the riser section during said lowering step.

2. The vessel according to claim 1, wherein the water or other liquid source comprises a reservoir and/or a water pump.

3. The vessel according to claim 1, wherein the liquid flow line is a hose.

4. The vessel according to claim 1, wherein the nozzle mount is configured to be releasable fixed to a top end of the auxiliary pipe.

5. The vessel according to claim 1, wherein the nozzle mount is arranged on, or is configured to be arranged on, the riser string lifting tool of the vertical handling system.

6. The vessel according to claim 1, wherein the nozzle mount is provided with a positioning member which is to be mated with a portion of a top end of the riser section to position and/or secure the auxiliary pipe filling device on the riser section.

7. The vessel according to claim 1, wherein the at least one nozzle is movably supported by the nozzle mount, such that the at least one nozzle can be moved between the filling position and a non-operative position, in which filling position the at least one nozzle is positioned adjacent to or partially inserted into an open top end of the at least one auxiliary pipe of a riser section, and in which non-operative position the at least one nozzle is positioned away from the open end of the at least one auxiliary pipe.

8. The vessel according to claim 1, wherein the nozzle is configured to be, at least partially, inserted in an open end of the at least one auxiliary pipe.

9. The vessel according to claim 1, wherein the nozzle is configured to be coupled with an open end of the at least one auxiliary pipe.

10. The vessel according to claim 9, wherein the nozzle is provided with a stab connector or with a connector sleeve that can be coupled with an inner or outer screw thread section of the auxiliary pipe.

11. The vessel according to claim 1, wherein the auxiliary pipe filling device is provided with a valve, the valve can be remotely operated such that the valve can be opened when the riser section is engaged by the riser string lifting tool and in the upended position, to enable the auxiliary pipe to be filled while the riser section is being lowered along the firing line.

12. The vessel according to claim 11, wherein the valve is a hydraulically actuated valve.

13. The vessel according to claim 1, wherein the support allows for removal of the liquid flow line from the support when the filling device is not in use.

14. The vessel according to claim 1, wherein, when the riser string lifting tool is in a lifted position and supports a new, riser section in the firing line above the riser spider, the liquid flow line extends from a working deck to the top end of the riser section supported by the riser string lifting tool.

15. The vessel according to claim 1, wherein, when the riser string lifting tool is in a lowered position in which the riser string lifting tool is located near the riser spider, the liquid flow line extends from a top end of the tower to the top end of the riser section supported by the riser string lifting tool.

16. A method for running of a subsea riser string by interconnection of riser sections, to compose a riser string that extends between a vessel and a subsea wellbore, wherein the riser string is assembled from releasably interconnected riser sections that comprise a main riser pipe and at least one auxiliary pipe, the method comprising the steps:

engaging a top end of the riser section with a riser string lifting tool;

positioning a nozzle in a filling position at a top end of the at least one auxiliary pipe of the riser section;

securing a lower end of the riser section with a top end of the riser string;

filling the at least one auxiliary pipe using the nozzle while lowering the riser section and the riser string connected thereto; and using the vessel according to claim 1 to compose the riser string.

17. The method according to claim 16, the method further comprising:

installing a blowout preventer (BOP) stack, wherein the riser section comprises the main riser pipe and two or more auxiliary pipes on the outside of and along the main riser pipe, and wherein the two or more auxiliary pipes are to be used as choke/kill lines extending from the vessel to the BOP stack located at the sea floor;

moving the BOP stack to a position in a firing line, and moving a first riser section including choke/kill lines in the firing line, the riser section being positioned above the BOP stack; and connecting the first length of the main riser pipe and the two or more choke/kill lines to said BOP stack.

18. A riser string lifting tool comprising a nozzle mount and/or a nozzle of an auxiliary pipe filling device adapted to fill at least one auxiliary pipe of a riser section during a lowering step of a riser running operation, and wherein the riser string lifting tool is provided with a liquid flow line support that is configured to support at least a section of a liquid flow line, wherein the auxiliary pipe filling device further comprises:

a water or other liquid source; and the liquid flow line, wherein the liquid flow line is flexible, and is of such a length that it the liquid flow line can follow the riser section from an upended position where the riser section is arranged vertically above a riser string, to a lowered position where the new added riser section is suspended from a riser spider device, allowing a consecutive riser section to be coupled to the riser section, the liquid flow line connecting the water or other liquid source with the nozzle, wherein the nozzle is adapted to dispense water or other liquid into said auxiliary pipe, and wherein the nozzle mount is adapted to mount the nozzle in a filling position in which the nozzle is positioned to dispense the water or other liquid into the at least one auxiliary pipe of the riser section during said lowering step.

19. A method for running of a subsea riser string by interconnection of riser sections, to compose a riser string that extends between a vessel and a subsea wellbore, wherein the riser string is assembled from releasably interconnected riser sections that comprise a main riser pipe and at least one auxiliary pipe, the method comprising the steps:

engaging a top end of the riser section with a riser string lifting tool;

positioning a nozzle in a filling position at a top end of the at least one auxiliary pipe of the riser section;

securing a lower end of the riser section with a top end of the riser string;

filling the at least one auxiliary pipe using the nozzle while lowering the riser section and the riser string connected thereto; and using a riser string lifting tool according to claim 18 to compose the riser string.

* * * * *